US008468638B2

(12) United States Patent
Patel

(10) Patent No.: US 8,468,638 B2
(45) Date of Patent: Jun. 25, 2013

(54) MUSICAL APPARATUS

(76) Inventor: Anish Patel, Fontana, CA (US)

( * ) Notice: Subject to any disclaimer, the term of this patent is extended or adjusted under 35 U.S.C. 154(b) by 123 days.

(21) Appl. No.: 13/172,942

(22) Filed: Jun. 30, 2011

(65) Prior Publication Data

US 2011/0252587 A1 Oct. 20, 2011

(51) Int. Cl.
*A46B 15/00* (2006.01)

(52) U.S. Cl.
USPC ..... 15/105; 15/167.1

(58) Field of Classification Search
USPC ..... 15/105, 167.1, 22.1
See application file for complete search history.

(56) References Cited

U.S. PATENT DOCUMENTS

| | | | | |
|---|---|---|---|---|
| 5,956,796 | A * | 9/1999 | Lodato | 15/167.1 |
| 7,143,462 | B2 * | 12/2006 | Hohlbein | 15/111 |
| 7,845,041 | B2 * | 12/2010 | Gatzemeyer et al. | 15/105 |
| 8,051,520 | B2 * | 11/2011 | Pfenniger et al. | 15/22.1 |
| 2005/0066461 | A1 * | 3/2005 | Chang | 15/105 |
| 2005/0225971 | A1 * | 10/2005 | Melnik | 362/202 |
| 2007/0261185 | A1 * | 11/2007 | Guney et al. | 15/22.1 |

* cited by examiner

*Primary Examiner* — Shay Karls
(74) *Attorney, Agent, or Firm* — LeonardPatel PC

(57) ABSTRACT

One or more embodiments of the present invention pertain to a toothbrush. The toothbrush includes a head comprising bristles and a body operatively connected to the head including two buttons configured to cause the toothbrush to play at least two different audio when pressed. The toothbrush also includes a lower body operatively connected to the body.

15 Claims, 13 Drawing Sheets

MUSICAL APPARATUS

FIELD

The present invention relates to a musical apparatus and, more particularly, to a musical toothbrush that allows a user to switch and/or play different audio while brushing.

BACKGROUND

Toothbrushes, when used properly, are effective for improving dental hygiene. However, many times, the task of brushing one's teeth becomes tedious. As a result, people generally brush very quickly or even brush once a day rather than brushing two or three times a day for a two-minute duration, as recommended by the American Dental Association. Some toothbrushes now play music for a duration of two-minutes in attempt to encourage brushing for the recommended time period.

SUMMARY

Certain embodiments of the present invention may provide solutions to the problems and needs in the art that have not yet been fully identified, appreciated, or solved by current musical toothbrushes.

In accordance with an embodiment of the present invention, an apparatus is provided. The apparatus includes a replaceable head that operatively connects to a body of the apparatus and a lower body that operatively connects to the body of the apparatus. The body includes a first button configured to cause a processor play audio when activated and stop playing the audio when deactivated, and a second button configured to cause the processor play another audio when activated and stop playing the other audio when deactivated.

In accordance with another embodiment of the present invention, a toothbrush is provided. The toothbrush includes a head having bristles and a body operatively connected to the head. The body includes two buttons configured to cause the toothbrush to play at least two different audio when pressed. The toothbrush also includes a lower body operatively connected to the body.

BRIEF DESCRIPTION OF THE DRAWINGS

For a proper understanding of the invention, reference should be made to the accompanying figures. These figures depict only some embodiments of the invention and are not limiting of the scope of the invention. Regarding the figures.

DETAILED DESCRIPTION OF THE EMBODIMENTS

It will be readily understood that the components of the invention, as generally described and illustrated in the figures herein, may be arranged and designed in a wide variety of different configurations. Thus, the following detailed description of the embodiments is not intended to limit the scope of the invention as claimed, but is merely representative of selected embodiments of the invention.

The features, structures, or characteristics of the invention described throughout this specification may be combined in any suitable manner in one or more embodiments. For example, the usage of "certain embodiments," "some embodiments," or other similar language, throughout this specification refers to the fact that a particular feature, structure, or characteristic described in connection with an embodiment may be included in at least one embodiment of the invention. Thus, appearances of the phrases "in certain embodiments," "in some embodiments," "in other embodiments," or other similar language, throughout this specification do not necessarily all refer to the same embodiment or group of embodiments, and the described features, structures, or characteristics may be combined in any suitable manner in one or more embodiments.

One or more embodiments described herein pertain to a musical toothbrush configured to play at least two audio (i.e., songs, music, sounds, beats, etc.). One audio can be played while brushing in the morning and the other audio can be played while brushing at night, for example. The toothbrush may use soft bristles having an ergonomic design to clean plaque in hard-to-reach places and may utilize a tongue cleaner to clean the person's tongue. The toothbrush may also include replaceable brush heads, at least two musical buttons, and replaceable batteries.

Figure 1:
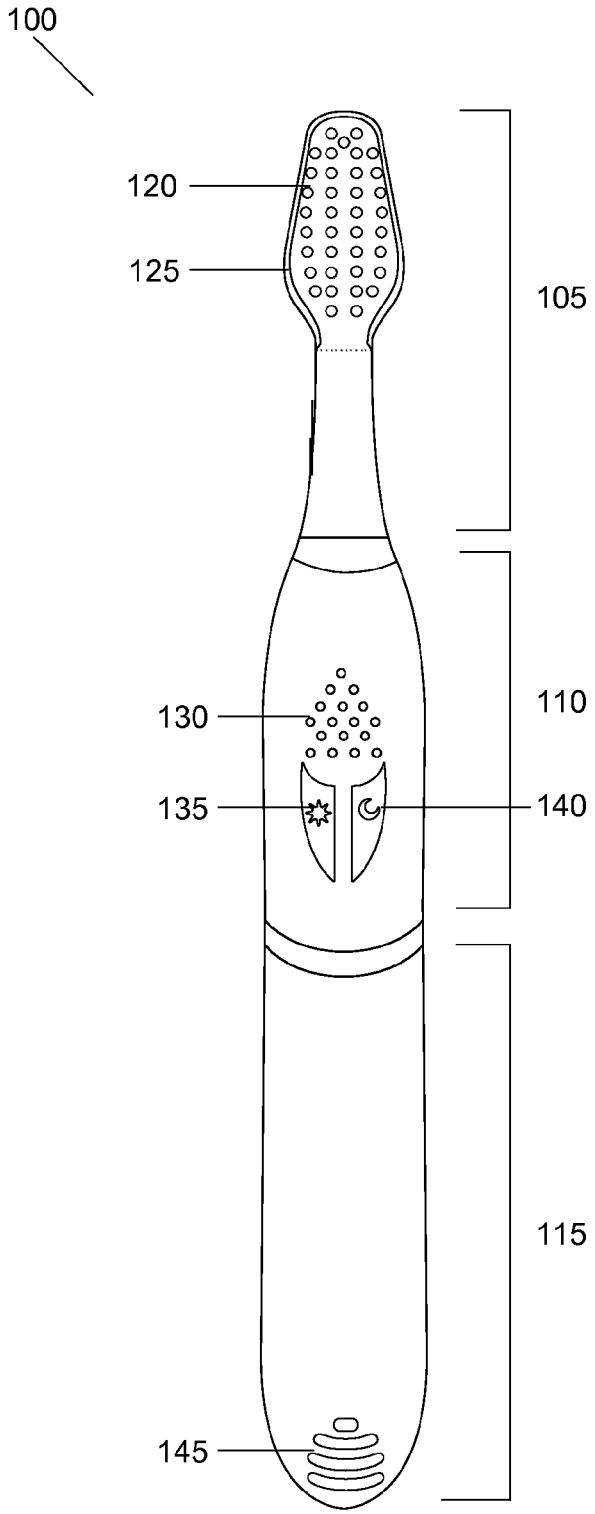
FIG. 1 illustrates a front-view of a musical toothbrush, in accordance with an embodiment of the present invention.

FIG. 1 illustrates a front-view of a toothbrush 100, in accordance with an embodiment of the present invention. Toothbrush 100 includes three components, i.e., a first component (or upper body) 105, a second component (or middle body) 110, and a third component (or lower body) 115.

In this embodiment, first component 105 is a brush head that includes bristles 120 and a rubber coating 125. Bristles 120 can be multi-level and angled to help remove plaque more efficiently. Rubber coating 125 provides the user with a comfortable brushing experience. A person of ordinary skill in the art would appreciate that the coating need not be made of rubber, but can be any type of coating that would enhance the user's experience while brushing, such as certain plastics, fibers, woods, or any other suitable material. First component 105 can be attached to and detached from second component 110. This allows the brush head to be replaced, for example, every three (3) months, as recommended by dentists.

Second component 110 is operatively connected to first component 105 and third component 115. Second component 110 includes a module (not shown) that includes a central processing unit (CPU) or processor, a battery, and a speaker, all of which are interconnected via electronic wiring. See FIGS. 7-9 for a more detailed description of the module.

Second component 110 also includes a grip 130 and two buttons 135, 140. Grip 130 can be made of rubber, a rubber-like material, or any material that would enhance a user's experience of holding the toothbrush while brushing his or her teeth. While not in any particular order, button 135 can be configured to play audio, such as a song, sound and/or music, while brushing in the morning and button 140 can be configured to play music while brushing at night. Buttons 135, 140 may have an illustration of a sun and a moon, for instance, to instruct the user when to press the button.

Also, when button 135 or 140 is pressed, the music is activated and starts to play for two (2) minutes, which is the dentist recommended time to brush teeth. It should be appreciated that the duration of the music can be configured to play more or less than two minutes, as would be appreciated by one of ordinary skill in the art. If the user presses button 135 or 140 before the two-minute duration, then the music is deactivated and stops playing. If the user presses button 135 or 140 a subsequent time, the music is activated and plays for two minutes or until the music is deactivated. However, it should be appreciated that the music can be configured to continue to play from the time when the music was deactivated.

Third component 115 includes sound apertures 145 to allow music waves to travel. Apertures 145 may also allow any water drawn into third component 115 to exit and mitigate against muffling of the music.

It should be appreciated that toothbrush 100 may be constructed in such a manner as to prevent bristles 120 from contacting, for example, a countertop in a bathroom. For instance, if toothbrush 100 is laid on its face, then second component 110 is configured to rotate to the left side or the right side of toothbrush 100. Such a configuration facilitates a more hygienic toothbrush.

Figure 2:
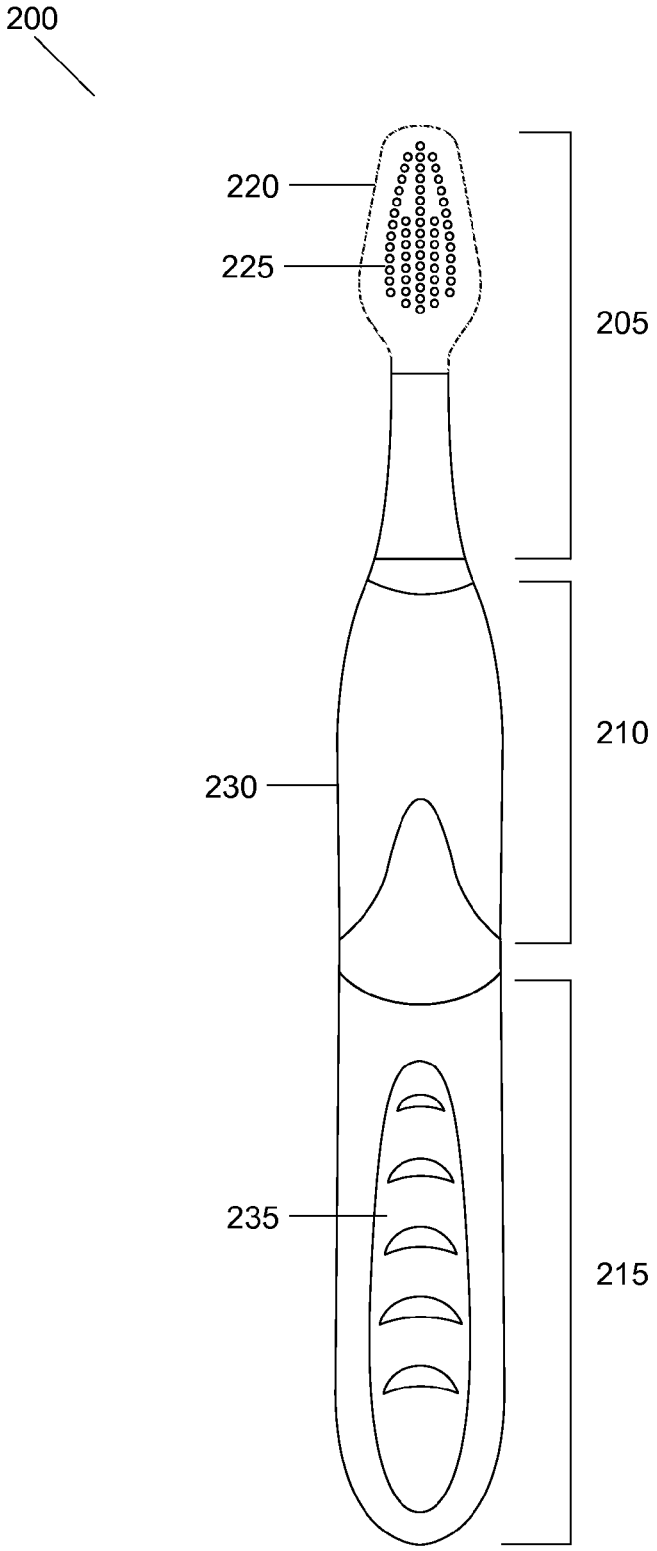
FIG. 2 includes a back-view of a musical toothbrush, in accordance with an embodiment of the present invention.

FIG. 2 includes a back-view of a musical toothbrush 200, in accordance with an embodiment of the present invention. Toothbrush 200 includes a first component 205, a second component 210, and a third component 215.

First component 205 includes a soft rubber coated material 220 to facilitate a comfortable brushing experience and a tongue cleaner 225 to allow a user to clean his or her tongue while brushing. Second component 210 includes a first grip 230. First grip 230 can be made of a rubber material, or any material that would enhance a user's experience when holding the brush. Third component 215 includes a second grip 235 that can be made of rubber material, or any material that would enhance a user's experience when holding the brush.

It should be appreciated that the head of toothbrush 200 may be prevented from contacting, for example, a counter in a bathroom. For instance, the width of the left and the right side of second component 210 and third component 215 are configured such that toothbrush 200 is prevented from rotating and that neither the bristles nor tongue clear 225 contact the counter.

Figure 3:
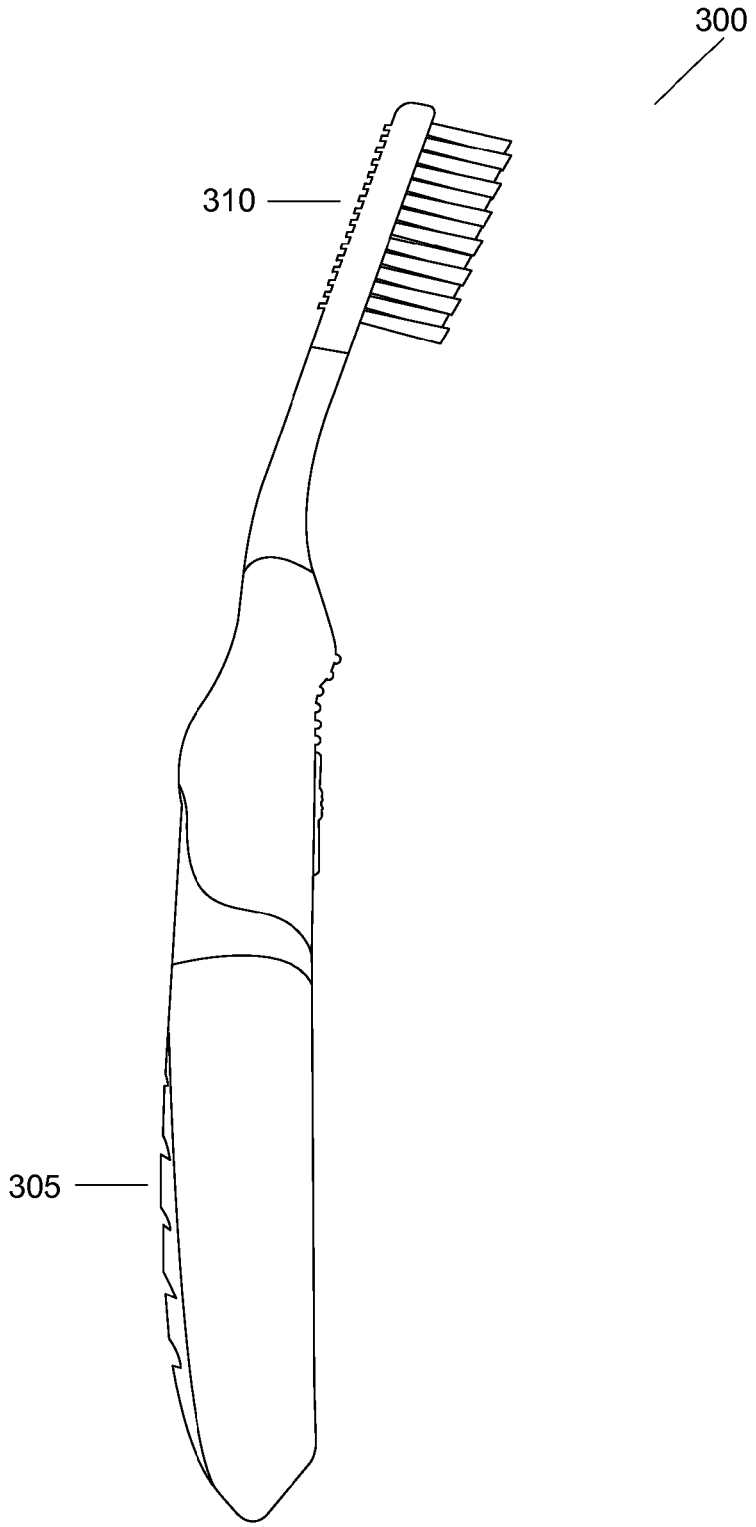
FIG. 3 illustrates a side-view of the musical toothbrush, in accordance with an embodiment of the present invention.

FIG. 3 illustrates a side-view of the musical toothbrush 300, in accordance with an embodiment of the present invention. For hygiene purposes, it should be appreciated that when back-portion 305 of toothbrush 300 is lying on the counter, tongue cleaner 310 is prevented from contacting the counter. This configuration prevents bacteria from directly contacting the tongue cleaner.

Figure 4:
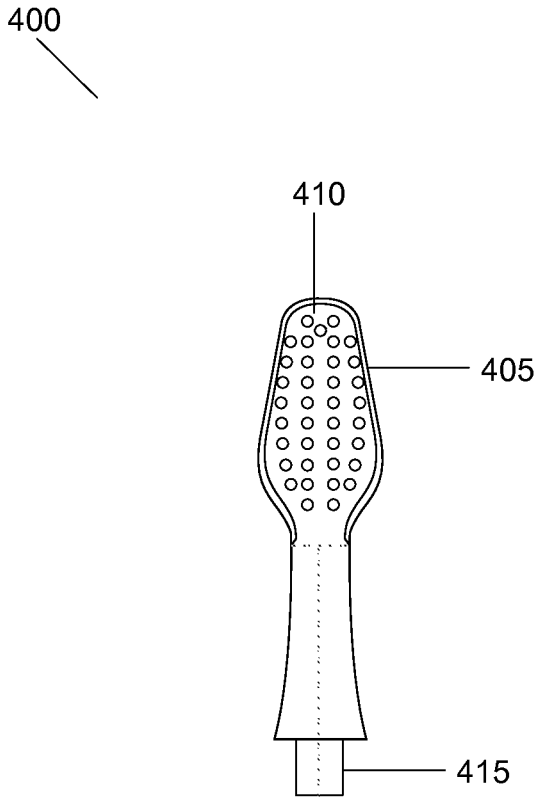
FIG. 4 illustrates a first component of the musical toothbrush, in accordance with an embodiment of the present invention.

FIG. 4 illustrates a first component 400 of the musical toothbrush, in accordance with an embodiment of the present invention. First component 400 includes a head of the toothbrush. The head of the toothbrush includes a soft outer coating 405 and bristles 410. First component 400 also includes a connector 415 that operatively connects first component 400 with the second component of the toothbrush. Connector 415 allows a user to replace the brush head every three (3) months, for example, as recommended by dentists.

Figure 5:
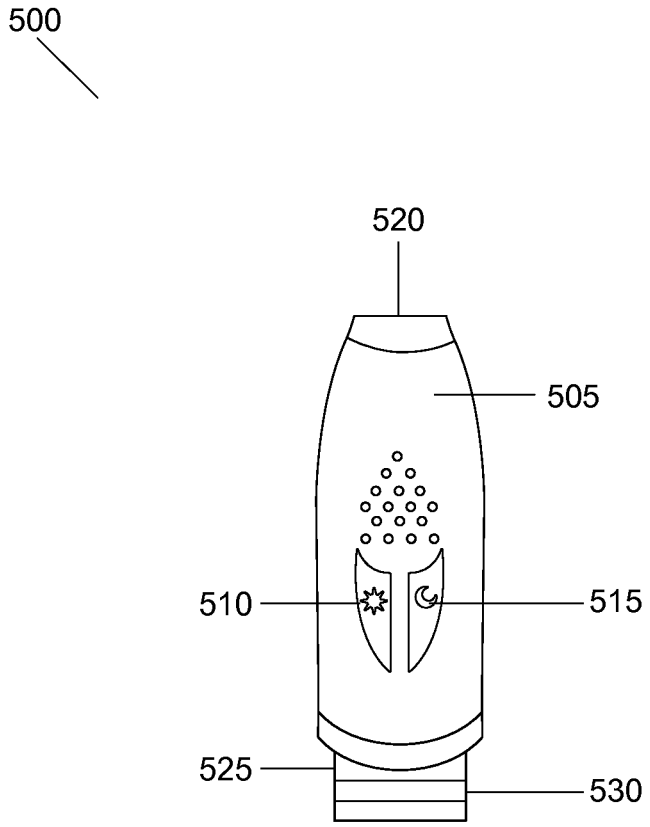
FIG. 5 illustrates a second component of the musical toothbrush, in accordance with an embodiment of the present invention.

FIG. 5 illustrates a second component 500 of the musical toothbrush, in accordance with an embodiment of the present invention. Second component 500 includes a grip 505, buttons 510 and 515, an opening 520, a connector 525, and a slot 530 for a waterproof band.

Opening 520 is configured to securely receive the connector of the first component such that the first component and the second component of the musical toothbrush securely fasten together. Connector 525 is configured to operatively connect second component 500 with the third component of the toothbrush. As a result, the second and third components of the toothbrush can securely fasten together.

Because second component 500 and the third component can house the processor, battery, and the audio device, connector 525 utilizes slot 530 for a waterproof band to prevent liquid or water from entering the second and third components. As a result, malfunctioning of the processor, battery, and/or audio device is significantly reduced.

Figure 6:
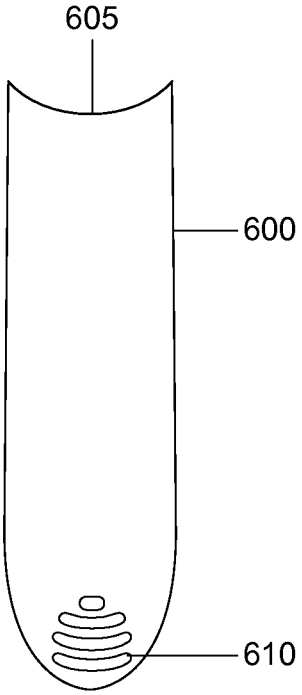
FIG. 6 illustrates a third component of the musical toothbrush, in accordance with an embodiment of the present invention.

FIG. 6 illustrates a third component 600 of the musical toothbrush, in accordance with an embodiment of the present invention. Third component 600 includes an opening 605 and apertures 610. Opening 605 is configured to securely receive the connector of the second component such that the second and third components of the toothbrush are securely fastened together. Also, portions of the module shown in FIGS. 7-9, can be securely placed within third component 600.

Figure 7:
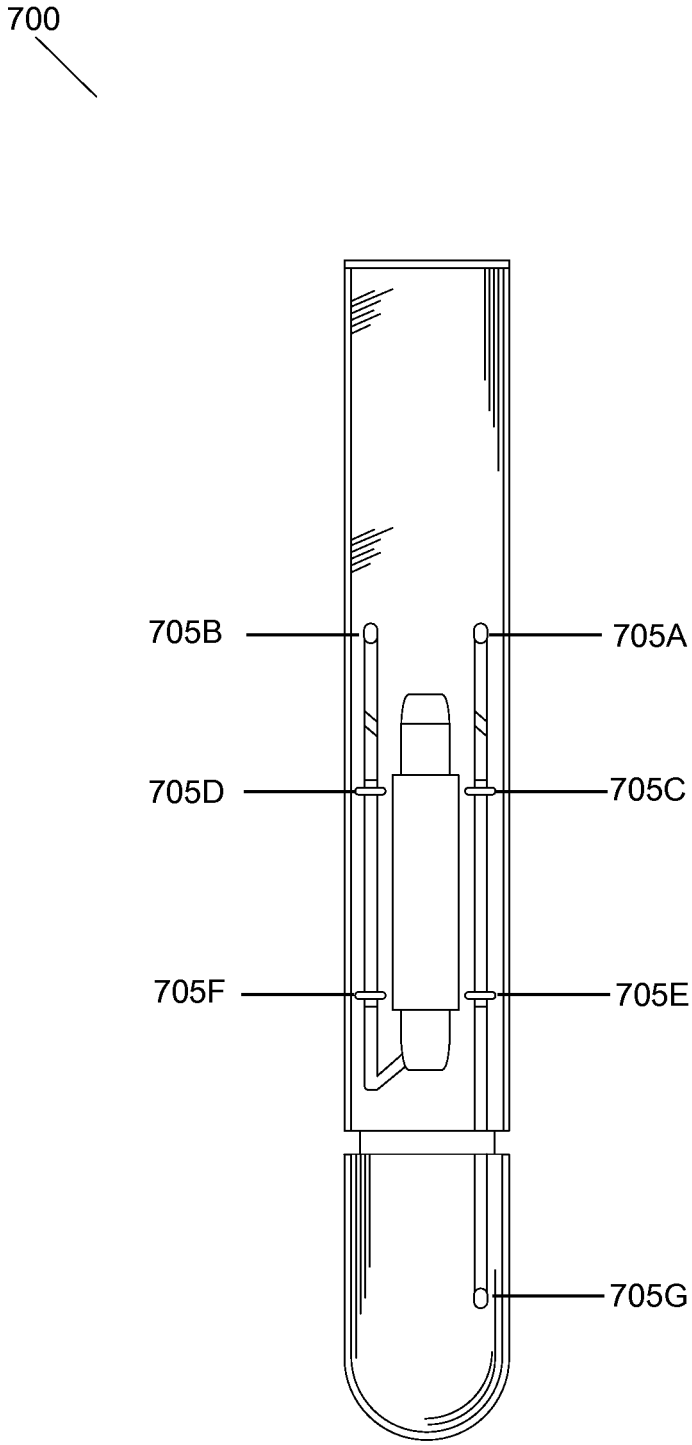
FIG. 7 illustrates a shell of a module of the musical toothbrush, in accordance with an embodiment of the present invention.

FIG. 7 illustrates a shell of a module 700 of the musical toothbrush, in accordance with an embodiment of the present invention. The body of module 700 includes at least seven welds 705A-G. Welds 705A-G are configured to electronically connect the processor, battery, and audio device via electronic cables. A person of ordinary skill in the art will readily appreciate that more or less than seven welds may be utilized in order to electronically connect the processor, batter, and audio device via the electronic cables.

Figure 8:
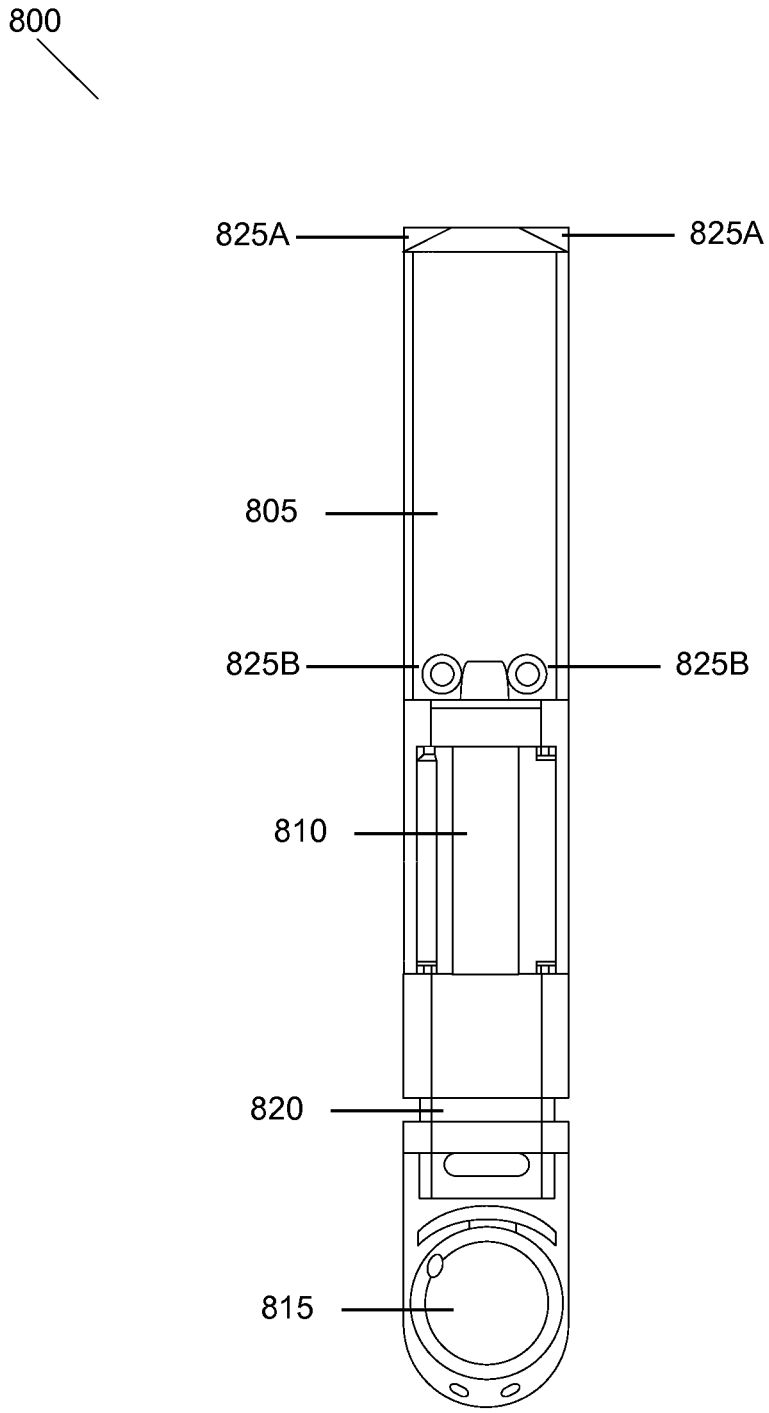
FIG. 8 illustrates a top-view of a module of the musical toothbrush, in accordance with an embodiment of the present invention.

FIG. 8 illustrates a top-view of a module 800, in accordance with an embodiment of the present invention. Module (or inner compartment) 800 can be housed in the second compartment and/or third compartment of the musical toothbrush. Module 800 can include one or more sub-compartments. For instance, module 800 includes an electronic board compartment 805, a battery compartment 810, an audio device compartment 815, and a slot 820 for a waterproof band.

Electronic board compartment 805 houses an electronic circuit board (not shown). In order for electronic board compartment 805 to house a processor or circuit board, mounts 825A and B are utilized. The circuit board can include a processor and two buttons that, when pressed, activate and/or deactivate the music. The circuit board can also include memory to store at least two audio, each audio having a playtime of two minutes. However, a person of ordinary skill in the art will readily appreciate that the audio can have a playtime of more or less than two minutes. For instance, the audio can have a playtime of one minutes, two minutes, three minutes, etc.

One or more batteries housed in battery compartment 810 are configured to power the processor or circuit board. The one or more batteries are also configured to power the audio device. It should be appreciated that electronic cables (not shown) may electronically connect the processor, the one or more batteries, and the audio devices. The one or more batteries may be button batteries, thumb cell batteries, AAA batteries, or any type of battery that will be readily appreciated by a person of ordinary skill in the art. Battery compartment 810 is configured to allow the one or more batteries to be replaced. Audio device compartment 815 is configured to house the audio device (not shown).

Because liquid, water, or toothpaste may enter the toothbrush through the apertures described above when a person brushes his or her teeth, a waterproof band is utilized. The band is configured to prevent liquid, water, or toothpaste from entering battery compartment 810 and/or electronic board compartment 805. In other words, to prevent the processor or one or more batteries from malfunctioning, the band prevents liquid, water, or toothpaste from contacting the same. The band can be made of a rubber-like material, or any type of material that will prevent liquid, water, or toothpaste from entering battery compartment 810 and/or electronic board compartment 805.

Figure 9:
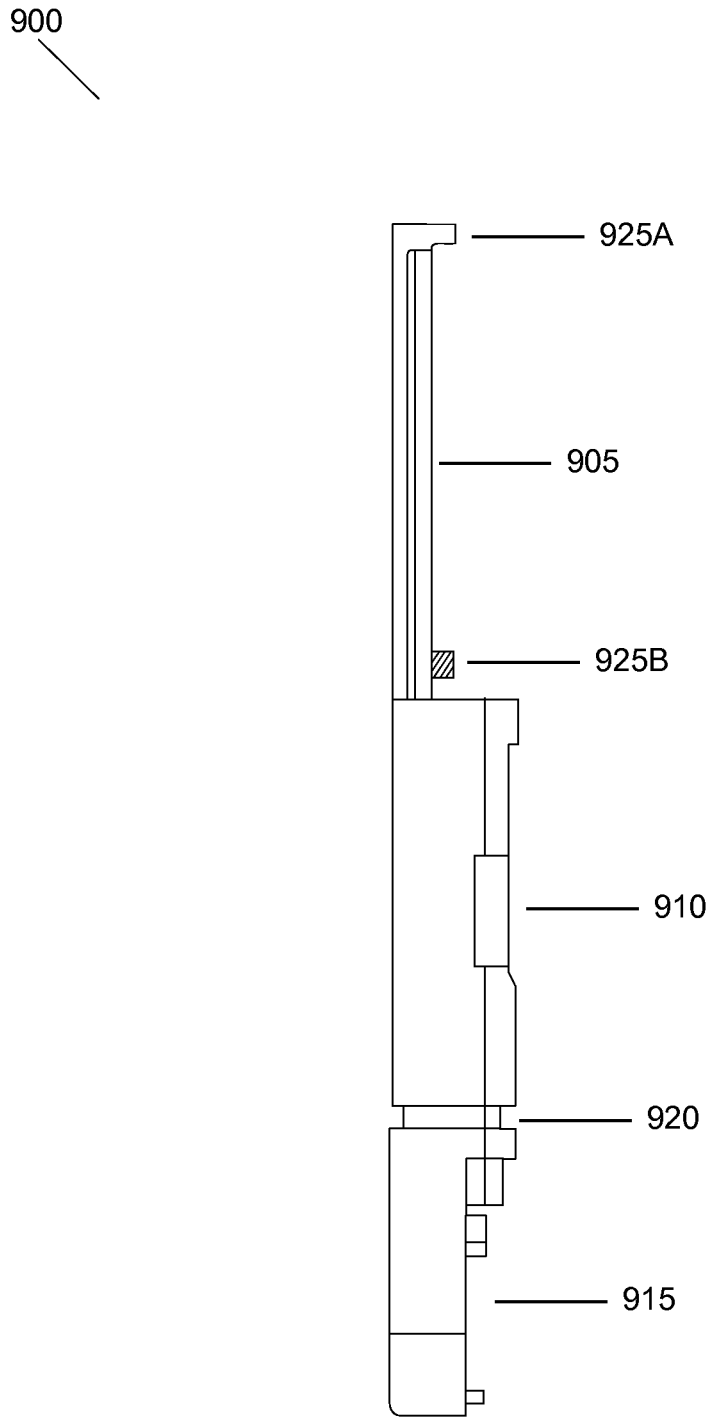
FIG. 9. Illustrates a side-view of a module of the musical toothbrush, in accordance with an embodiment of the present invention.

FIG. 9. Illustrates a side-view of a module 900 of the musical toothbrush, in accordance with an embodiment of the present invention. Module 900 includes an electronic board compartment 905, a battery compartment 910, an audio device compartment 915, and a slot 920 for a waterproof band. In order for electronic board compartment 905 to house a processor or circuit board, mounts 925A and B are utilized.

Figure 10:
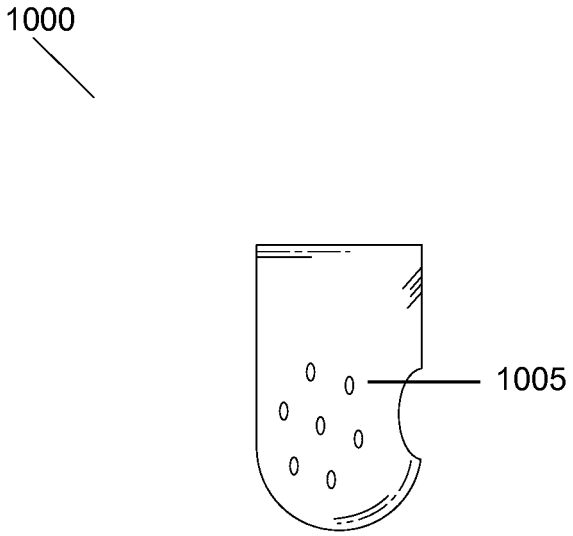
FIG. 10 illustrates an audio device cover, in accordance with an embodiment of the present invention.

FIG. 10 illustrates an audio device cover 1000, in accordance with an embodiment of the present invention. Generally, when water, liquid, or toothpaste enters the inner compartment described above through the apertures of the third compartment of the toothbrush, the audio, or sound, from the audio device becomes muffled. In order to prevent the audio from muffling or scattering, audio device cover 1000 is operatively connected to the audio compartment of the inner compartment of the toothbrush. Audio device cover 1000 includes openings 1005. Openings 1005 may be circular, rectangular, or any shape that would be appreciated by a person of ordinary skill in the art. Openings 1005 prevent water, liquid, or toothpaste from being confined to the inner compartment of the toothbrush and allow water, liquid, or toothpaste to exit the inner compartment of the toothbrush.

Furthermore, when audio device cover 1000 is connected to the audio compartment, a hollow space is created between the audio device housed in the audio compartment and audio device cover 1000. The hollow space allows sound waves to bounce from audio device cover 1000 onto the audio device and through openings 1005 in audio device cover 1000 and apertures. As a result, the sound, or audio quality, is enhanced.

Figure 11:
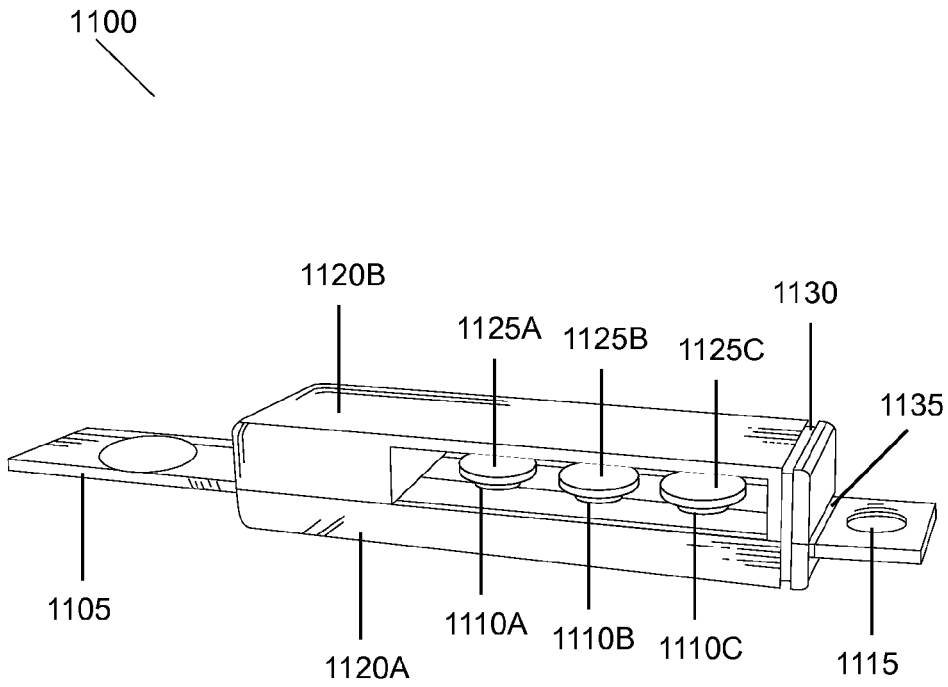
FIG. 11 illustrates a module of a musical toothbrush, in accordance with another embodiment of the present invention.

FIG. 11 illustrates a module 1100 of a musical toothbrush, in accordance with another embodiment of the present invention. Module (or inner compartment) 1100 includes a circuit board 1105. Circuit board 1105 can include, but is not limited to, a processor, memory, and buttons. Circuit board 1105 also includes battery holders 1110A-C and an audio device holder 1115. An upper compartment 1120A and lower compartment 1120B can be affixed to board 1105 to form a battery compartment. Because the battery compartment has opening on two side of module 1100, batteries 1125A-C can be removed or inserted from either side of the battery compartment. However, a person of ordinary skill in the art will readily appreciate that the batteries can be removed and inserted into battery holders 1110A-C in any direction.

The battery compartment also includes a waterproof slot 1130 that includes a band. The band prevents water, liquid or toothpaste from traversing inside the toothbrush. Also, in order to prevent water, liquid or toothpaste from entering the battery compartment, module 1100 utilizes waterproof epoxy glue 1135. However, it should be appreciated that any type of substance or material may be used in place of glue 1135 to prevent water from entering the battery compartment.

Figure 12:
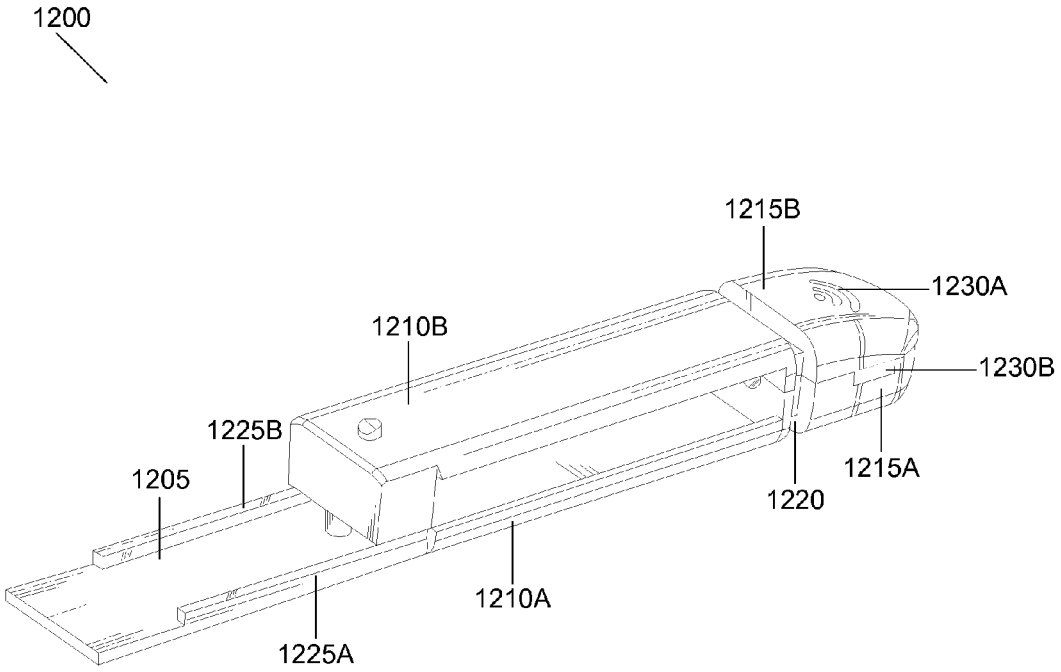
FIG. 12 illustrates a module of a musical toothbrush, in accordance with another embodiment of the present invention.

FIG. 12 illustrates a module 1200 of a musical toothbrush, in accordance with another embodiment of the present invention. Module 1200 includes an electronic board compartment 1205, a lower and upper battery compartment 1210A, B to hold the batteries and form a battery compartment, and a lower and upper audio device compartment 1215A, B to hold the audio device and form an audio device compartment. Electronic board compartment 1205 includes mounts 1225A, B to mount or hold the circuit board to module 1200. It should also be appreciated that the circuit board can be situated between mounts 1225A, B and extend into the battery compartment such that the circuit board may include replaceable batteries.

Module 1200 also includes a waterproof slot 1220 to prevent water, liquid, and/or toothpaste from entering the battery compartment or the circuit board compartment, via the audio device compartment. Upper audio device compartment 1215B includes apertures 1230A in order to prevent water, liquid and/or toothpaste from staying in the audio device compartment. Upper and lower audio device compartment 1215A, B are configured to form another aperture 1230B on both sides of the audio device compartment. Aperture 1230B also allows audio waves, as well as water, liquid, and/or toothpaste, to exit without any disturbance.

Figure 13:
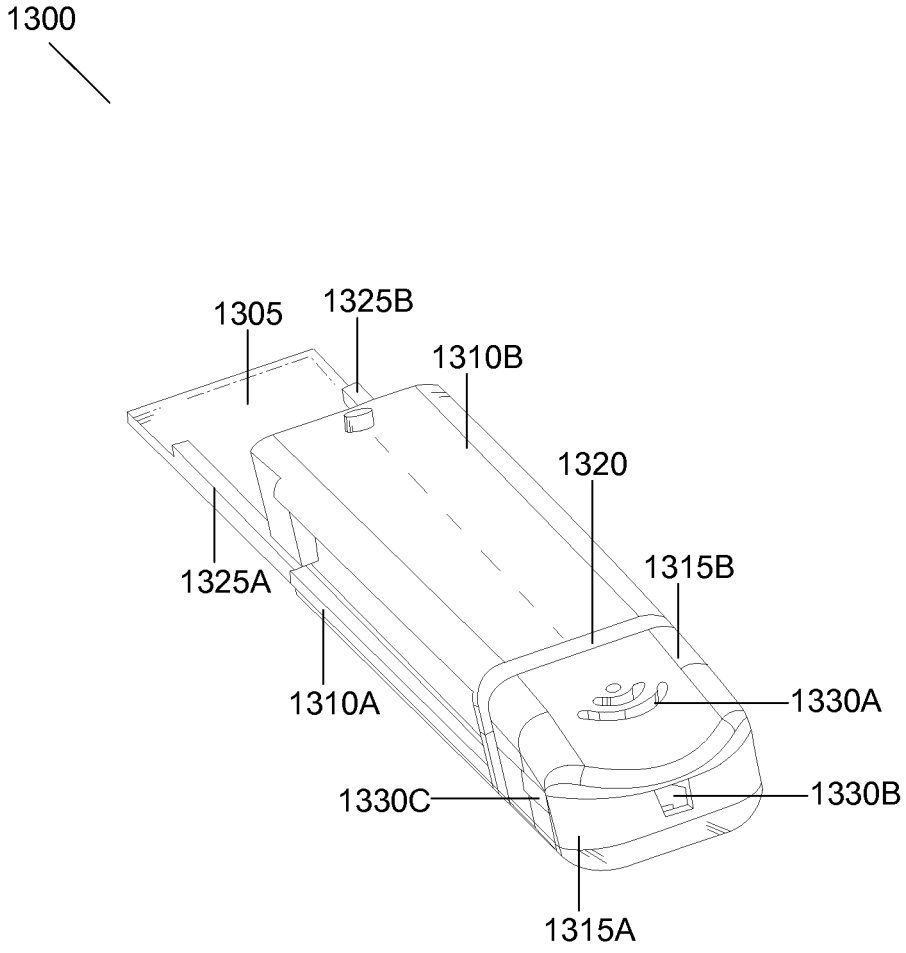
FIG. 13 illustrates a module of a musical toothbrush, in accordance with another embodiment of the present invention.

FIG. 13 illustrates a module 1300 of a musical toothbrush, in accordance with another embodiment of the present invention. Module 1300 includes an electronic board compartment 1305, a lower and upper battery compartment 1310A, B to hold the batteries, a lower and upper audio device compartment 1315A, B to hold the audio device. Electronic board compartment 1305 includes mounts 1325A, B to mount the circuit board to module 1300.

Module 1300 also includes a waterproof slot 1320 to prevent water, liquid, and/or toothpaste from entering the battery compartment or the circuit board compartment, via the audio device compartment. Upper audio device compartment 1315B includes apertures 1330A in order to prevent water, liquid and/or toothpaste from staying in the audio device compartment.

Upper and lower audio device compartment 1315A, B are configured to form another aperture 1330B, as well as aperture 1330C on both sides of the audio device compartment. Apertures 1230B and C allow audio waves, as well as water, liquid, and/or toothpaste, to travel and/or exit from the audio device compartment without any disturbance. This configuration is also beneficial, as the apertures prevent water, for example, from drying and malfunctioning the audio device.

It should be appreciated that a computer program may control the electronic functionalities of the toothbrush. The computer program may be embodied on a non-transitory computer readable medium. The computer readable medium may be, but is not limited to, a hard disk drive, a flash device, a random access memory, a tape, or any other such medium used to store data. The computer program product may include encoded instructions for controlling the nonlinear adaptive processor to implement the functions of the toothbrush.

The computer program can be implemented in hardware, software, or a hybrid implementation. The computer program can be composed of modules that are in operative communication with one another, and which are designed to pass information or instructions to display. The computer program can be configured to operate on a general purpose computer, or an application specific integrated circuit ("ASIC").

One having ordinary skill in the art will readily understand that the invention as discussed above may be practiced with steps in a different order, and/or with hardware elements in configurations that are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a replaceable head operatively connected to a body of the apparatus;

a lower body operatively connected to the body of the apparatus; and a module housed within the body and extending into the lower body of the apparatus, wherein the module comprises a battery compartment housing replaceable batteries, the battery compartment is configured to allow the replaceable batteries to be inserted into the battery compartment from one side of the battery compartment and removed from another side of the battery compartment, the body comprises a first button configured to cause the apparatus play audio when pressed and deactivate the audio when pressed a subsequent time, and the body comprises a second button configured to cause the apparatus play different audio when pressed and deactivate the different audio when pressed a subsequent time.

2. The apparatus of claim 1, wherein the body further comprises:

an internal compartment comprising a processor, memory, one or more batteries, and an audio device.

3. The apparatus of claim 2, wherein the memory is configured to store at least two audio files, and each audio file is configured to play for duration of at least one minute, at least two minutes, or at least three minutes.

4. The apparatus of claim 2, wherein the one or more batteries comprise replaceable batteries.

5. The apparatus of claim 2, wherein the audio device is configured to output sound waves in order for a user to listen to the audio stored in the memory.

6. The apparatus of claim 1, wherein the replaceable head comprises an outer coating.

7. The apparatus of claim 1, wherein the body comprises a connector configured to connect the body to the lower body of the apparatus.

8. The apparatus of claim 7, wherein the connector comprises a waterproof band configured to prevent water, liquid, or toothpaste from traversing into an internal component of the body.

9. The apparatus of claim 8, wherein the internal component comprises another waterproof band located between a battery compartment and an audio device compartment, the other waterproof band configured to prevent water, liquid, or toothpaste from traversing into the battery compartment and a processor compartment.

10. A toothbrush, comprising:

a head comprising bristles;

a body operatively connected to the head comprising two buttons configured to cause the toothbrush to play at least two different audio recordings when pressed;

a lower body operatively connected to the body; and a module housed within the body and extending into the lower body of the toothbrush, wherein the module comprises a battery compartment housing replaceable batteries, the battery compartment is configured to allow the replaceable batteries to be inserted into the battery compartment from one side and removed from another side of the battery compartment, and the two buttons comprise a first button configured to cause the apparatus play audio when pressed and deactivate the audio when pressed a subsequent time, and a second button configured to cause the apparatus play different audio when pressed and deactivate the different audio when pressed a subsequent time.

11. The toothbrush of claim 10, wherein the module comprises:

a circuit compartment that houses a circuit board;

an audio device compartment that houses an audio device; and a band located between the battery compartment and the audio device, the band configured to prevent liquid, water, or toothpaste from entering the battery compartment and circuit compartment.

12. The toothbrush of claim 11, wherein the audio device compartment is operatively connected to an audio device cap configured to allow the liquid, water, or toothpaste to exit through apertures of the lower body of the toothbrush.

13. The toothbrush of claim 10, wherein the body comprises a connector operatively connected to the lower body of the toothbrush.

14. The toothbrush of claim 13, wherein the connector comprises a band configured to prevent liquid, water, or toothpaste from entering into the module via the connector.

15. The toothbrush of claim of claim 10, wherein the head of the toothbrush is a replaceable head and comprises an outer coating and a tongue cleaner.

* * * * *